United States Patent [19]

Shimada et al.

[11] Patent Number: 4,861,548

[45] Date of Patent: Aug. 29, 1989

[54] SEAWATER-CORROSION-RESISTANT NON-MAGNETIC STEEL MATERIALS

[75] Inventors: Haruo Shimada; Yoshiaki Sakakibara, both of Kawasaki, Japan

[73] Assignee: Nippon Steel Corporation, Tokyo, Japan

[21] Appl. No.: 141,224

[22] Filed: Jan. 6, 1988

Related U.S. Application Data

[63] Continuation-in-part of Ser. No. 40,103, Jan. 20, 1987, abandoned.

[30] Foreign Application Priority Data

Apr. 30, 1986 [JP] Japan ..... 61-100234
May 23, 1986 [JP] Japan ..... 61-117539
Apr. 2, 1987 [JP] Japan ..... 62-81664

[51] Int. Cl.[4] ..... C22C 38/06

[52] U.S. Cl. ..... 420/79; 420/80; 420/81

[58] Field of Search ..... 420/77, 79, 80, 81, 420/583, 584

[56] References Cited

U.S. PATENT DOCUMENTS 2,499,862 3/1950 Hansen et al. ..... 420/77

*Primary Examiner*—Deborah Yee
*Attorney, Agent, or Firm*—Wenderoth, Lind & Ponack

[57] ABSTRACT

A non-magnetic steel composition suitable for use in various steel and concrete structures, particularly magnetic floating high-speed railways, nuclear fusion facilities and marine structures and appliances where non-magnetic property is required. The steel composition contains C: not more than 1.0%

Si: not more than 0.25%

Mn: not more than 2.0%

Al: more than 20.0 to 37.3%

Cr: more than 1.0 to 5.5%

P: not more than 0.015%

S: not more than 0.005% and may further contain at least one of Ti, V, Nb, W, Mo, and B in an amount ranging from 0.01 to 0.5%, in total, for the elements other than B and in an amount ranging from 0.0001 to 0.005% for B, and at least one of Cu and Ni in an amount ranging from 0.1 to 5.5%, in total.

5 Claims, No Drawings

SEAWATER-CORROSION-RESISTANT NON-MAGNETIC STEEL MATERIALS

This is a Continuation-in-part of Ser. No. 040,103, filed Jan. 20, 1987, which is now abandoned.

BACKGROUND OF THE INVENTION

1. Field of the Invention

The present invention relates to a non-magnetic steel composition suitable for use in various steel and concrete structures, particularly magnetic floating high-speed railways, nuclear fusion facilities and marine structures and appliances where non-magnetic property is required.

The steel materials suitable for the above applications must have good corrosion resistance, and therefore the present invention also relates to a non-magnetic steel composition useful for preventing the decay of marine steel and concrete structures and similar structures which may be built on seashores in particular.

2. Description of the Related Art

In recent years, various methods for preventing the decay of steel and concrete structures which are built on the ocean and seashores have been proposed and indeed some of these have already been put into practice.

The principal cause for the decay of steel structure includes the corrosion by the seawater itself and corrosion by the sea salt particles. Meanwhile the principal cause for the decay of concrete structures has been found to be attributable to the fact that reinforcing steel bars or wires embedded in the concrete structure are corroded by salts contained in sea sand used when mixing the concrete or by sea salt particles which permeate into a concrete structure built on a seashore or in the seawater. The corrosion salts have an increased volume of about 2.2 times, and the concrete fails to withstand the expansion forces of the corroding steel bars or wires. The concrete thus cracks along the embedded reinforcing bars or wires. When the cracks grow to about 0.2 mm or larger, external corrosive media, such as oxygen, salts, and carbon dioxide in the air, penetrate these cracks to reach the interior of the concrete mass where the reinforcing bars or wires are embedded. This further promotes the corrosion of the bars or wires, or accelerates neutralization of the concrete, causing premature decay of the concrete structures.

Also, in recent years, trials have been made to prepare steel materials containing 15% or more manganese for the purpose of obtaining the non-magnetic property, but one critical problem confronting all of these Mn-containing steel materials is that the rust generation rate is remarkable, higher than ordinary carbon steels, hence a higher corrosion rate in the presence of a very small amount of salt.

Therefore, a main object of the present invention is to completely prevent the corrosion of structures built with non-magnetic steel materials and the concrete decay of concrete structures reinforced with non-magnetic steel wires, which may be built on the seashores. These problems of steel corrosion and concrete decay in the marine environments have been given keen attention in various fields of industries.

More imminent problems now to be solved are in connection with concrete structures more than 20 years old. In many fields, the free salt content around the reinforcing bars or wires embedded in the concrete structures may be as high as 1.0% in terms of NaCl in severe marine environments, and this causes serious corrosion of the reinforcing bars or wires, which in turn causes and promotes cracking of the concrete.

Therefore, it has been strongly desired to resist attack by a high concentration of free salt, thus almost completely eliminating the possible corrosion of steel structure and cracking of a concrete structure, which may be exposed to a very high concentration of salt.

The above objects of the present invention can be achieved by building steel structures and reinforcing concrete structures with a seawater-corrosion-resistant non-magnetic steel material containing not more than 1.0% carbon, not more than 0.25% silicon, not more than 2.0% manganese, more than 20.0 up to 37.3% aluminum, 1.0 to 5.5% chromium, not more than 0.015% phosphous, and not more than 0.005% sulfur, optionally with one or more of Ti, V, Nb, W, Mo, and B, in an amount ranging from 0.01 to 0.5%, in total for the elements other than B, and in an amount ranging from 0.0001 to 0.005% for B, and one or more of Cu and Ni in an amount ranging from 0.1 to 5.5%, in total, with the balance being iron and unavoidable impurities.

The most important features of the present invention reside in that a relatively large amount of Al is contained in the steel so as to lower the Si and S contents in the steel and also to obtain a stabilized non-magnetic property.

The advantage obtained by the limitation of Si and S contents in steel and the relatively large contents of Al are described as follows. The lowered Si content in the steel will suppress the formation and growth of rust and the content of MnS which creates the nuclei for rust formation is markedly lowered along with the lowering of S content in the steel so that the deterioration of corrosion resistance can be minimized, and the increased Al content in the steel will strengthen the passivated film formed on the surface of the high-manganese steel so that the passivated film, even exposed to a high concentration of salt, is not destroyed, thus preventing the rust formation.

An explanation will be made as to the reasons for limiting the contents of the individual elements as defined in the present invention.

Carbon is limited to an amount of not more than 1.0% for the reason that more than 1.0% carbon will cause embrittlement of the steel. A lower carbon content is more desirable because carbon has a large tendency, when heated during heat treatments, to form magnetic complex carbides consisting of Fe, Al and C. A preferable carbon range is from 0.001 to 0.1%.

The reason for limiting the Si content to an amount not more than 0.25% is that Si is necessary to assure the required strength of the steel and to control the non-metallic inclusions, but a lower Si content will markedly suppress the rust formation. For these conflicting purposes, the Si content is limited to an amount not more than 0.25%. A preferable Si content is not more than 0.05%.

The Mn content is limited to an amount not more than 2.0% because Mn contents more than 2.0% will cause difficulties in hot rolling. From the point of rust prevention, Mn contents not more than 1.0% are preferable.

The P content is limited to an amount not more than 0.015% for the reason that P contents more than 0.015% produce no effect to suppress the rust formation in an alkaline environments such as concrete, but rather tend to promote the rust formation.

Aluminum is the most important metal element in the steel composition according to the present invention. And the reason for limiting the Al content to an amount ranging from more than 20.0 to 37.3% is that with Al contents of 20% or less the de-magnetization of the steel is not sufficient, but with Al contents more than 37.3%, there is a great tendency to produce intermetallic compounds between Al and Fe, which cause embrittlement of the steel, thus prohibiting the hot rolling. A preferable Al content ranges from 20.5 to 28.0%.

Chromium is limited to an amount ranging from 1.0 to 5.5%, for the reason that a chromium addition will improve the corrosion resistance in such a severe corrosion environment as exposure to alternate wetting by sea water and drying, and hot workability of steel when Al content is 20.0% or more, but a chromium content of more than 5.5% is not economical.

The S content is limited to an amount not more than 0.005% for the purpose of reducing the content of MnS which is the cause for the formation of rust. Incidentally, Ca and rare earth metal elements used as desulfurization agent to lower the S content may convert MnS into (Mn, Ca)S and so on thereby additional corrosion resistance improvement can be expected.

The above procedure for lowering the sulfur content is a common practice in the art and it is very often that the steel contains a small amount of Ca and rare earth metal elements as Ce, but the presence of these elements is permissible because they will not produce adverse effects on the corrosion resistance of the steel.

According to the present invention, Ti, V, Nb, W, Mo, and B may be added when desired to improve the strength and toughness of the steel as is conventional. One or more of these elements are added in an amount ranging from 0.01 to 0.5% for a single element or in combination for the elements other than B, and in an amount ranging from 0.0001 to 0.005% for B. The addition of these elements for the above purposes is conventionally known.

Further, when required, one or more of Cu, and Ni may be added in an amount ranging from 0.1 to 5.5%, in total.

Still further, for applications such as screwed concrete reinforcing wires where free cutting property is required, 0.01 to 0.5% Pb may be added.

A steel having the chemical composition mentioned hereinbefore may be prepared by melting in a converter or electric furnace, then the steel is subjected to ingot-making and breaking-down, or to continuous casting, then to rolling and heat treatments such as quenching, annealing, normalizing and patenting, if necessary, and finally drawing into bars or wires for final use. However, the final products may be supplied in the forms of pipes, H-sections, concrete reinforcing bars, wires, and sheets, and if necessary, may further applied with Zn coatings and organic coatings.

The present invention will be better understood from the following description of the preferred embodiments of the present invention.

EXAMPLE 1

Steels having the chemical compositions shown in Table 1 were melted in a vacuum melting furnace, and subjected to ingot-making, breaking-down and then hot rolling. Comparative corrosion tests were made with conventional steel compositions and the results are shown in the table.

The test pieces were prepared by sampling a piece of 25 mm in width, 60 mm in length and 2 mm in thickness from the central portion of the rolled sheet as prepared above and mechanically grinding the surface of the piece. On the other hand, artificial seawater was prepared to provide a laboratory simulation environment to promote or reproduce the corrosion of the steels actually used on the seashores and in the seawater.

Then the test pieces surface-ground as above were covered with silicone resin on both the front and back sides, degreased, dried, and then immediately immersed in the artificial seawater. The seawater was replaced every seven days and the immersion was continued for 50 days to observe the rust formation.

Then, for the purpose of promoting or reproducing the corrosion by salt of reinforcing steel wires embedded in concrete, an aqueous solution of $Ca(OH)_2$ +NaCl (pH 12) was prepared by dissolving CaO which is the main component of the concrete into 3.6% NaCl solution.

Then the test pieces surface ground as above were covered with silicone resin on both sides, degreased, dried and then immediately immersed in the aqueous solution above prepared. During the test period, the surface of the solution was sealed with floating paraffin, and the solution was replaced every three days, and the immersion was continued for 20 days to observe the rust formation. The results are shown in Table 1.

EXAMPLE 2

Hot rolled steel sheets having the chemical compositions shown in Table 1 were surface ground and exposed on the seashore for one year to observe the rust formation.

Also hot rolled steel bars (9 mm in diameter) having the chemical compositions shown in Table 1 were embedded in concrete mortar composed of sand containing 1.0% NaCl, portland cement, water and aggregates and aged for 28 days at room temperatures and then exposed on the seashore for one year. The ratio of water to cement in the concrete was 0.60 and the embedding depth was 2 mm.

As understood from the results shown in Table 1, the steel materials according to the present invention show no rust formation in the seawater and even in concrete containing salt, as high as 1.0% NaCl contained in the sand, and 3.6% NaCl contained in the water so that the concrete decay caused by the rust formation and growth on the reinforcing steel bars embedded therein can be completely prevented. Therefore it can be presumed that the steel materials according to the present invention, when used in steel structures and concrete structures built on the seashores or on the ocean can prevent the decay of the structures even under very severe marine conditions.

The steel materials according to the present invention can assure the durability of structures built with non-magnetic steel materials as well as concrete structures reinforced with non-magnetic steel bars, exposed to the salt attack, and can be used in wide applications including magnetic floating railways where non-magnetic property is required, which may be built on seashores and exposed to the salt attack.

TABLE 1

| No. | Chemical Composition (weight %) | | | | | | | |
|---|---|---|---|---|---|---|---|---|
| | C | Si | Mn | P | S | Al | Cr | Others (Fe balance and impurities) |
| 1 | 0.17 | 0.23 | 30.0 | 0.017 | 0.023 | 0.005 | | Ni 0.08 Cu 0.27 |
| 2 | 0.78 | 0.20 | 17.0 | 0.008 | 0.008 | 0.03 | | |
| 3 | 0.58 | 0.25 | 35.0 | 0.008 | 0.007 | 0.03 | 6.0 | |
| 4 | 0.001 | 0.10 | 0.5 | 0.008 | 0.003 | 21.5 | 5.0 | |
| 5 | 0.002 | 0.03 | 0.5 | 0.008 | 0.001 | 22.0 | 5.0 | Ni 0.5 |
| 6 | 0.001 | 0.03 | 0.3 | 0.010 | 0.002 | 21.8 | 4.8 | Cu 0.3 |
| 7 | 0.003 | 0.05 | 0.5 | 0.008 | 0.002 | 23.0 | 5.5 | Nb 0.05 |
| 8 | 0.002 | 0.03 | 0.3 | 0.011 | 0.001 | 23.5 | 5.5 | V 0.2 |
| 9 | 0.01 | 0.02 | 0.3 | 0.008 | 0.002 | 22.0 | 5.5 | Mo 0.1 |
| 10 | 0.10 | 0.03 | 0.5 | 0.010 | 0.002 | 23.1 | 5.5 | W 0.2 |
| 11 | 0.05 | 0.20 | 0.01 | 0.006 | 0.001 | 23.0 | 2.0 | Cu 0.2, Ni 0.3, Mo 0.2 |
| 12 | 0.002 | 0.05 | 0.01 | 0.012 | 0.001 | 27.3 | 2.0 | Cu 2.0, Ni 1.0, Ti 0.06 |
| 13 | 0.032 | 0.03 | 0.3 | 0.008 | 0.002 | 21.8 | 5.0 | Cu 0.2, Ti 0.25 |
| 14 | 0.030 | 0.05 | 0.3 | 0.010 | 0.003 | 21.5 | 4.8 | Ti 0.26 |
| 15 | 0.05 | 0.03 | 0.5 | 0.008 | 0.005 | 22.8 | 5.5 | Ti 0.20, B 0.001 |
| 16 | 0.05 | 0.05 | 0.3 | 0.010 | 0.003 | 23.0 | 5.0 | Ti 0.20, V 0.2 |
| 17 | 0.001 | 0.03 | 0.5 | 0.008 | 0.002 | 27.0 | 5.5 | V 0.3 |
| 18 | 0.002 | 0.05 | 0.2 | 0.010 | 0.001 | 23.2 | 5.1 | Cu 1.0, Ni 0.5 |
| 19 | 0.010 | 0.10 | 0.3 | 0.007 | 0.002 | 25.1 | 5.0 | Ti 0.08 |
| 20 | 0.015 | 0.05 | 0.3 | 0.008 | 0.001 | 23.8 | 5.1 | Nb 0.07, Ti 0.1 |
| 21 | 0.011 | 0.07 | 0.2 | 0.007 | 0.002 | 25.1 | 5.0 | Nb 0.08, V 0.05 |
| 22 | 0.012 | 0.08 | 0.3 | 0.008 | 0.001 | 23.8 | 5.2 | Nb 0.1, B 0.001 |
| 23 | 0.012 | 0.10 | 0.3 | 0.008 | 0.001 | 25.1 | 5.2 | Ti 0.1, Nb 0.05 |
| 24 | 0.010 | 0.01 | 0.5 | 0.007 | 0.002 | 25.8 | 5.1 | Ti 0.1, V 0.1 |
| 25 | 0.010 | 0.01 | 0.7 | 0.003 | 0.002 | 23.8 | 5.5 | Nb 0.1, Cu 1.0, Ni 0.5 |
| 26 | 0.011 | 0.02 | 0.2 | 0.008 | 0.001 | 25.1 | 4.7 | Cu 2.0, Ni 1.0, V 0.1 |
| 27 | 0.010 | 0.01 | 0.2 | 0.007 | 0.002 | 25.1 | 5.0 | Cu 1.0, Ni 1.0, Ti 0.1, Nb 0.5 |
| 28 | 0.011 | 0.02 | 0.3 | 0.008 | 0.001 | 26.1 | 5.1 | Cu 1.0, Ti 0.1, B 0.001 |

| No. | Test Results of Seawater Resistance of Steels | | Test Results of Seawater Resistance of Steel Bars Embedded in Concrete | | Magnetic Permeability (Room Temperatures) |
|---|---|---|---|---|---|
| | Rust Formation Area after Immersion in Artificial Seawater (%) | Rust Formation Area after Exposure on Seashore (%) | Rust Formation Area after Immersion in an Aqueous Solution of $Ca(OH)_2$ + 3.6% NaCl (%) | Rust Formation Area on Steel Bars Embedded in High-Salt Concrete (%) | |
| 1 | 100 | 100 | 3.5 | 100 | 1.002 |
| 2 | 100 | 100 | 5.7 | 100 | " |
| 3 | 100 | 100 | 4.8 | 100 | " |
| 4 | 0 | 0 | 0 | 0 | not more than 1.02 |
| 5 | 0 | 0 | 0 | 0 | " |
| 6 | 0 | 0 | 0 | 0 | " |
| 7 | 0 | 0 | 0 | 0 | " |
| 8 | 0 | 0 | 0 | 0 | " |
| 9 | 0 | 0 | 0 | 0 | " |
| 10 | 0 | 0 | 0 | 0 | " |
| 11 | 0 | 0 | 0 | 0 | " |
| 12 | 0 | 0 | 0 | 0 | " |
| 13 | 0 | 0 | 0 | 0 | " |
| 14 | 0 | 0 | 0 | 0 | " |
| 15 | 0 | 0 | 0 | 0 | " |
| 16 | 0 | 0 | 0 | 0 | " |
| 17 | 0 | 0 | 0 | 0 | " |
| 18 | 0 | 0 | 0 | 0 | " |
| 19 | 0 | 0 | 0 | 0 | " |
| 20 | 0 | 0 | 0 | 0 | " |
| 21 | 0 | 0 | 0 | 0 | " |
| 22 | 0 | 0 | 0 | 0 | " |
| 23 | 0 | 0 | 0 | 0 | " |
| 24 | 0 | 0 | 0 | 0 | " |
| 25 | 0 | 0 | 0 | 0 | " |
| 26 | 0 | 0 | 0 | 0 | " |
| 27 | 0 | 0 | 0 | 0 | " |
| 28 | 0 | 0 | 0 | 0 | " |

What is claimed is:

1. A seawater-corrosion-resistant non-magnetic steel material consisting essentially of C: not more than 1.0%
Si: not more than 0.25%
Mn: not more than 2.0%
Al: more than 20.0 up to 37.3%
Cr: 1.0 to 5.5%
P: not more than 0.015%
S: not more than 0.005%
Balance: iron and unavoidable impurities.

2. The steel material according to claim 1, further containing at least one of Ti, V, Nb, W, Mo, and B in an amount ranging from 0.01 to 0.5%, in total, for the element other than B and in an amount ranging from 0.0001 to 0.005% for B.

3. The steel material according to claim 1, further containing at least one of Cu and Ni in an amount ranging from 0.1 to 5.5%, in total.

4. The steel material according to claim 1, further containing at least one of Ti, V, Nb, W, Mo, and B in an amount ranging from 0.01 to 0.5%, in total, for the element other then B and in an amount ranging from 0.0001 to 0.005% for B, and at least one of Cu and Ni in an amount ranging from 0.1 to 5.5%, in total.

5. A seawater-corrosion-resistant non-magnetic steel material selected from the group consisting of the chemical compositions set forth below:

| Chemical Composition (weight %) | | | | | | | |
|---|---|---|---|---|---|---|---|
| C | Si | Mn | P | S | Al | Cr | Others, Fe balance and impurities |
| 0.001 | 0.01 | 0.5 | 0.008 | 0.003 | 21.5 | 5.0 | |
| 0.002 | 0.03 | 0.5 | 0.008 | 0.001 | 22.0 | 5.0 | Ni 0.5 |
| 0.001 | 0.03 | 0.3 | 0.010 | 0.002 | 21.8 | 4.8 | Cu 0.3 |

-continued

| Chemical Composition (weight %) | | | | | | | |
|---|---|---|---|---|---|---|---|
| C | Si | Mn | P | S | Al | Cr | Others, Fe balance and impurities |
| 0.003 | 0.05 | 0.5 | 0.008 | 0.002 | 23.0 | 5.5 | Nb 0.05 |
| 0.002 | 0.03 | 0.3 | 0.011 | 0.001 | 23.5 | 5.5 | V 0.2 |
| 0.01 | 0.02 | 0.3 | 0.008 | 0.002 | 22.0 | 5.5 | Mo 0.1 |
| 0.10 | 0.03 | 0.5 | 0.010 | 0.002 | 23.1 | 5.5 | W 0.2 |
| 0.05 | 0.20 | 0.01 | 0.006 | 0.001 | 23.0 | 2.0 | Cu 0.2, Ni 0.3, Mo 0.2 |
| 0.002 | 0.05 | 0.01 | 0.012 | 0.001 | 27.3 | 2.0 | Cu 2.0, Ni 1.0, Ti 0.06 |
| 0.032 | 0.03 | 0.3 | 0.008 | 0.002 | 21.8 | 5.0 | Cu 0.2, Ti 0.25 |
| 0.030 | 0.05 | 0.3 | 0.010 | 0.003 | 21.5 | 4.8 | Ti 0.26 |
| 0.05 | 0.03 | 0.5 | 0.008 | 0.005 | 22.8 | 5.5 | Ti 0.20, B 0.001 |
| 0.05 | 0.05 | 0.3 | 0.010 | 0.003 | 23.0 | 5.0 | Ti 0.20, V 0.2 |
| 0.001 | 0.03 | 0.5 | 0.008 | 0.002 | 27.0 | 5.5 | V 0.3 |
| 0.002 | 0.05 | 0.2 | 0.010 | 0.001 | 23.2 | 5.1 | Cu 1.0, Ni 0.5 |
| 0.010 | 0.10 | 0.3 | 0.007 | 0.002 | 25.1 | 5.0 | Ti 0.08 |
| 0.015 | 0.05 | 0.3 | 0.008 | 0.001 | 23.8 | 5.1 | Nb 0.07, Ti 0.1 |
| 0.011 | 0.07 | 0.2 | 0.007 | 0.002 | 25.1 | 5.0 | Nb 0.08, V 0.05 |
| 0.012 | 0.08 | 0.3 | 0.008 | 0.001 | 23.8 | 5.2 | Nb 0.1, B 0.001 |
| 0.012 | 0.10 | 0.3 | 0.008 | 0.001 | 25.1 | 5.2 | Ti 0.1, Nb 0.05 |
| 0.010 | 0.01 | 0.5 | 0.007 | 0.002 | 25.8 | 5.1 | Ti 0.1, V 0.1 |
| 0.010 | 0.01 | 0.7 | 0.003 | 0.002 | 23.8 | 5.5 | Nb 0.1, Cu 1.0, Ni 0.5 |
| 0.011 | 0.02 | 0.2 | 0.008 | 0.001 | 25.1 | 4.7 | Cu 2.0, Ni 1.0, V 0.1 |
| 0.010 | 0.01 | 0.2 | 0.007 | 0.002 | 25.1 | 5.0 | Cu 1.0, Ni 1.0, Ti 0.1, Nb 0.5 |
| 0.011 | 0.02 | 0.3 | 0.008 | 0.001 | 26.1 | 5.1 | Cu 1.0, Ti 0.1, B 0.001 |

* * * * *